United States Patent [19]

Bruemmer

[11] Patent Number: 4,578,866

[45] Date of Patent: Apr. 1, 1986

[54] ILLUMINATED FOOT MEASURING GRID

[76] Inventor: Michael J. Bruemmer, 125 Gull Dip, Ridge, N.Y. 11961

[21] Appl. No.: 652,108

[22] Filed: Sep. 19, 1984

[51] Int. Cl.[4] ..... A43D 1/00

[52] U.S. Cl. ..... 33/3 B

[58] Field of Search ..... 33/3 R, 3 A, 3 B, 3 C, 33/174 D

[56] References Cited

U.S. PATENT DOCUMENTS

| | | | |
|---|---|---|---|
| 1,745,144 | 1/1930 | Bliss | 33/3 C |
| 2,175,116 | 10/1939 | Hack et al. | 33/3 B |
| 2,518,798 | 8/1950 | Legg, Jr. | 33/3 A |
| 2,592,188 | 4/1952 | Rosenberg et al. | 33/3 B |
| 2,876,544 | 3/1959 | Kallmeyer | 33/3 A |

FOREIGN PATENT DOCUMENTS

| | | | |
|---|---|---|---|
| 519013 | 4/1953 | Belgium | 33/3 A |
| 493076 | 2/1930 | Fed. Rep. of Germany | 33/3 A |
| 657398 | 3/1938 | Fed. Rep. of Germany | 33/3 A |
| 991996 | 2/1983 | U.S.S.R. | 33/3 C |

*Primary Examiner*—Richard R. Stearns

*Attorney, Agent, or Firm*—Richard L. Miller

[57] ABSTRACT

An illuminated foot measuring grid is provided which allows any number of users to measure foot size by standing upon a rear illuminated measuring grid work. The grid is also warmed by the illuminating source and is a great comfort to the user. While supported by a rigid frame, the top illuminated panels are actually a sandwich of three light transmitting panels. The bottom, very thick panel provides structural support. The intermediate panel contains the graphic grid work as well as any advertising and decorative colored regions. The top panel is a thin disposable panel which is replaced when it becomes worn. Chairs may also be placed upon the invention for user convenience and comfort.

9 Claims, 3 Drawing Figures

ILLUMINATED FOOT MEASURING GRID

BACKGROUND OF THE INVENTION

The present invention relates generally to the field of accessories for fitting shoes and, more specifically, to devices for measuring shoe size.

At the present state of the art, shoe sizes are determined in the retail trade by a caliper type shoe scale. The customer places a foot heel-first into the caliper and the shoe salesperson slides the front of the caliper forward until it reaches the longest toe and reads the shoe size from a calibrated scale. This technique requires physical contact with a frequently cold metal device which is often uncomfortable for the customer. Many people are also embarrassed to have another person in such close proximity to their feet. Children are also often frightened by the use of the caliper type shoe scale.

SUMMARY OF THE INVENTION

It is, therefore, a primary object of the present invention to provide an illuminated foot measuring grid in which the foot is placed on a back-lighted graphic representation so that it can be read at a distance. This eliminates the need for the salesman to make physical contact with the customer's foot.

Another object is to provide an illuminated foot measuring grid which also keeps the feet warm by virtue of heat emitted by the illuminating source.

A further object is to provide an illuminated foot measuring grid on which advertising messages may be placed.

A yet further object is to provide an illuminated foot measuring grid which provides structural strength for the light transmitting panel which contains the foot measuring grid. This is accomplished by using a light transmitting structural support panel under the graphic panel.

A still further object is to provide an illuminated foot measuring grid in which a light transmitting disposable panel covers the graphics panel so that when the disposable panel is worn it may simply and inexpensively be replaced.

A still further object is to provide an illuminated foot measuring grid in which any number of customers may be accommodated by placing pairs of foot measuring grids side by side.

A yet still further object is to provide an illuminated foot measuring grid upon which chairs may rest so that a customer may be comfortably seated.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
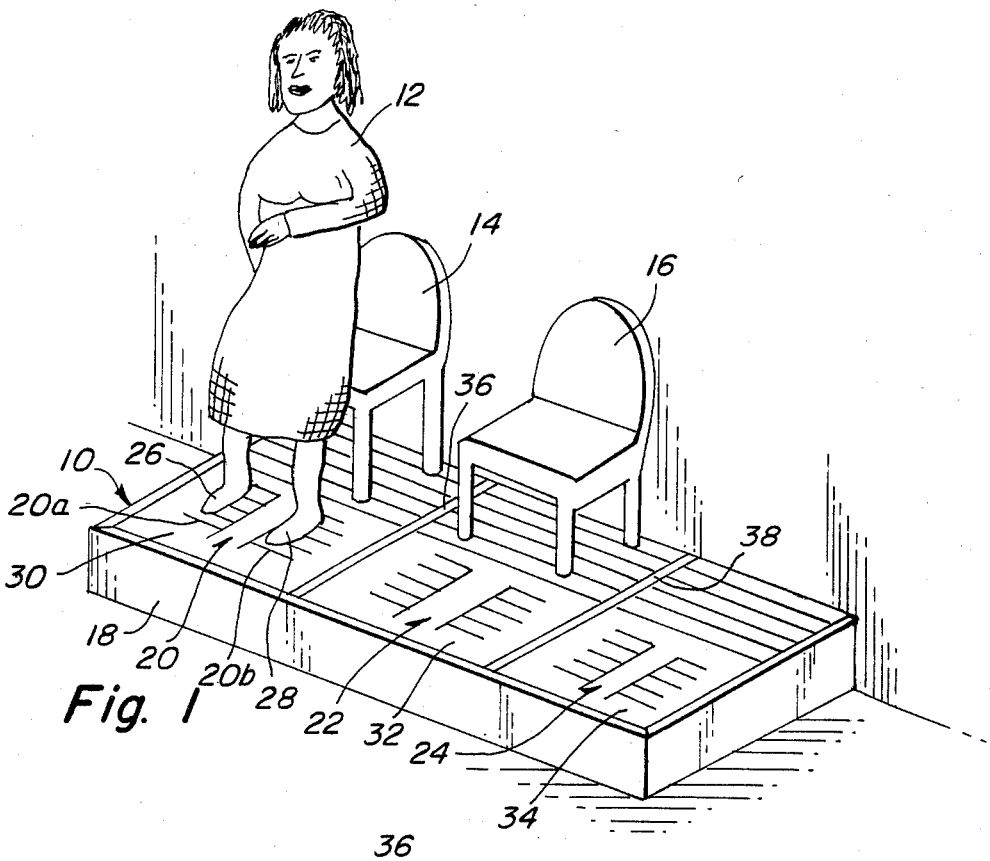
FIG. 1 is a perspective view of the invention in use.

In FIG. 1, a customer 12 is shown standing upon the invention 10. Chairs 14 and 16 are provided for comfort. The invention 10 is made of a rectangular open topped frame 18 which is typically made of wood or a plastic. Frame 18 may be opaque or translucent for a more dramatic effect. As illustrated, three people may simultaneously use this typical embodiment of the invention 10 as three pairs of foot measuring grids 20, 22 and 24 are provided. Customer 12 is shown with right foot 26 on measuring grid 20*a* and left foot 28 on measuring grid 20*b*.

The top surface of invention 10 may be constructed with three separate sets of panels 30, 32 and 34 separated by removable strips 36 and 38 which, typically have a cross section such as 40. These strips may be removed in order to replace the panels or change bulbs.

Figure 2:
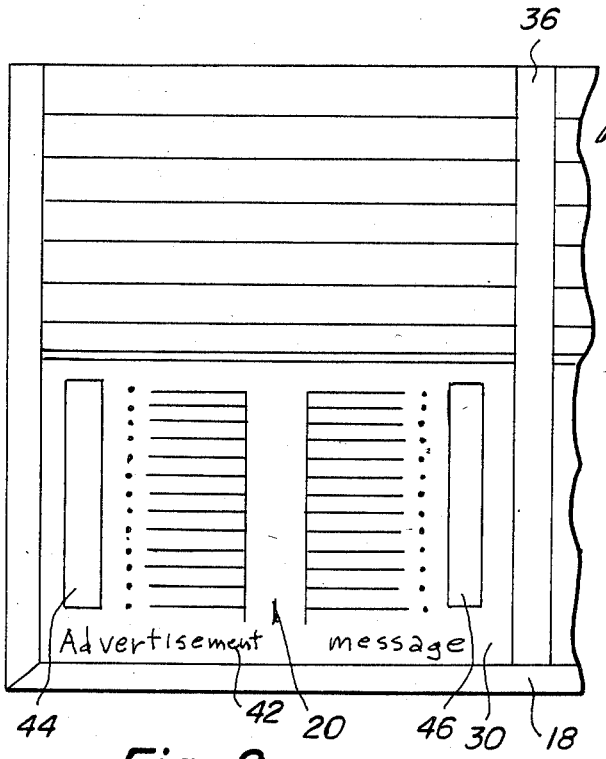
FIG. 2 is a top view of a portion thereof.

The detailed view in FIG. 2, illustrates how panel 30 may also contain an advertising message 42 as well as typical colored light transmitting regions 44 and 46 which add to the excitement of the display.

Figure 3:
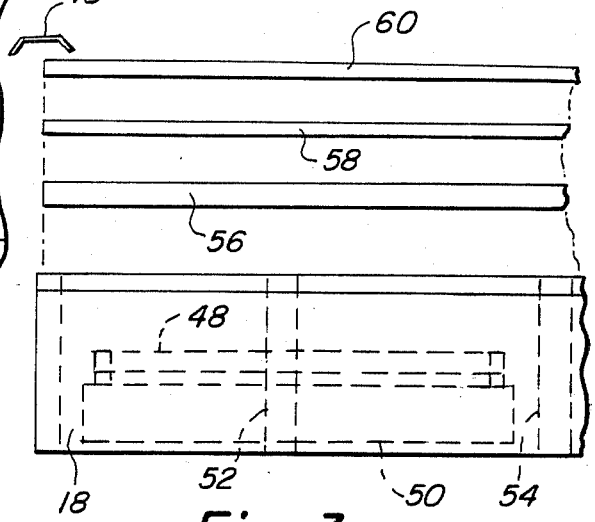
FIG. 3 is an exploded front view of a portion thereof.

The structure of the illuminating source and the top surface panels may be best understood with reference to FIG. 3. A fluorescent tube 48 installed in fluorescent lighting fixture 50 provides the light source and heat source. One long bulb may be used or one bulb for each pair of foot measuring grids may be used. Although a flourescent lamp is shown for illustrative purposes, it is understood that any other type of illuminating source, including incandescent, gaseous discharge types and solid-state sources, may be used. Structural support members 52 and 54 are provided to help support the weight on the top panels. The top panel system contains three separate panels. First, a thick light transmitting structural support panel 56 provides a rigid, durable, light transmitting support. The actual foot measuring grids 20, 22 and 24, advertising message 42 and colored panels 44 and 46 are imprinted upon light transmitting graphic panel 58. This is typically accomplished using silk screening although any other suitable printing process may be used. The top panel is a light transmitting disposable panel 60 which is easily replaced when worn. Panels 56, 58 and 60 are made, typically, of an acrylic plastic although any durable light transmitting material may be used.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. Illuminated foot measuring grid, comprising in combination:

(a) an opened top frame;

(b) a light and heat transmitting top surface which surmonts said opened top frame; wherein said light and heat transmitting top surface has at least one graphic design in the form of a pair of foot measuring grids formed on a light transmitting graphic panel mounted under a light and heat transmitting disposable panel, whereby when said light and heat transmitting disposable panel becomes worn it may be replaced simply and inexpensively, and wherein said light and heat transmitting top surface is divided into separate sections, each section including a pair of foot measuring grids formed on a graphic panel mounted under an associated disposable panel, whereby each section may be individually maintained and replaced, and means for retaining said separate sections firmly yet removably in place whereby each disposable panel can be easily and regularly replaced; and (c) a light and heat emitting source, contained within said opened top frame; wherein light thereby emitted passes through said light and heat transmitting top surface; thereby producing back lighting for said foot measuring grids while simultaneously providing a heat source in order to keep the temperature of said light and heat transmitting top surface at a comfortable level.

2. Illuminated foot measuring grid, as recited in claim 1, wherein said opened top frame is polygonal in shape.

3. Illuminated foot measuring grid, as recited in claim 1, wherein said opened top frame is rectangular in shape.

4. Illuminated foot measuring grid, as recited in claim 1, wherein said light transmitting top surface comprises a sandwich wherein a top layer comprises said light transmitting disposable panel; a middle layer comprises said light transmitting graphic panel; and, a bottom level comprises a light transmitting structural support panel.

5. Illuminated foot measuring grid, as recited in claim 1, wherein said light emitting source comprises a fluorescent light source.

6. Illuminated foot measuring grid, as recited in claim 1, wherein said light emitting source comprises an incandescent light source.

7. Illuminated foot measuring grid, as recited in claim 1, in which said graphic design further comprises written text.

8. Illuminated foot measuring grid, as recited in claim 1, in which said graphic design further comprises decorative light transmitting colored regions.

9. Illuminated foot measuring grid, as recited in claim 1, wherein said means for retaining said separate sections firmly yet removably in place comprises a removable strip placed between each of said sections, wherein said removable strip overlaps the top surface of said sections.

* * * * *